US010837662B2

(12) United States Patent
Maeda et al.

(10) Patent No.: US 10,837,662 B2
(45) Date of Patent: Nov. 17, 2020

(54) VENTILATION GRILLE AND VENTILATION FAN

(71) Applicant: Panasonic Intellectual Property Management Co., Ltd., Osaka (JP)

(72) Inventors: Shogo Maeda, Kagoshima (JP); Yasuaki Shima, Aichi (JP); Daisuke Kanematsu, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 257 days.

(21) Appl. No.: 15/844,843

(22) Filed: Dec. 18, 2017

(65) Prior Publication Data

US 2018/0180320 A1 Jun. 28, 2018

(30) Foreign Application Priority Data

Dec. 28, 2016 (JP) ..... 2016-254960

(51) Int. Cl.

| | |
|---|---|
| ***F24F 7/007*** | (2006.01) |
| ***F21V 33/00*** | (2006.01) |
| ***F24F 13/078*** | (2006.01) |
| ***F24F 13/08*** | (2006.01) |
| ***F24F 7/00*** | (2006.01) |

(52) U.S. Cl.

CPC ..... *F24F 7/007* (2013.01); *F21V 33/0088* (2013.01); *F24F 13/078* (2013.01); *F24F 13/082* (2013.01); *F24F 2007/001* (2013.01)

(58) Field of Classification Search

CPC ..... F24F 13/078; F24F 13/082; F24F 7/007; A47J 37/0704; A47J 37/0786; F24B 1/1895; F21K 9/20; F21K 9/237; F21V 19/0025; F21V 19/0035

USPC ..... 454/354

See application file for complete search history.

(56) References Cited

U.S. PATENT DOCUMENTS

| | | | | |
|---|---|---|---|---|
| 7,455,583 | B2 * | 11/2008 | Taya | F24F 7/06 454/256 |
| 7,600,883 | B2 * | 10/2009 | Deng | F21V 19/04 362/311.13 |
| 8,485,696 | B2 * | 7/2013 | Pringle | F21V 33/0088 362/373 |
| 8,770,774 | B2 * | 7/2014 | Ye | F21V 33/0096 362/96 |
| 9,022,846 | B1 * | 5/2015 | Tom | F21V 33/0096 454/338 |
| 9,157,630 | B2 * | 10/2015 | Li | F21V 31/03 |
| 9,188,132 | B1 * | 11/2015 | Tom | F24F 7/007 |
| 9,344,787 | B2 * | 5/2016 | Berkman | H04R 1/028 |
| 9,885,472 | B2 * | 2/2018 | Horng | F24F 13/078 |

(Continued)

FOREIGN PATENT DOCUMENTS

| | | |
|---|---|---|
| JP | 2011-242068 A | 12/2011 |
| JP | 2012-160341 A | 8/2012 |

*Primary Examiner* — Edelmira Bosques
*Assistant Examiner* — Frances F. Hamilton
(74) *Attorney, Agent, or Firm* — Pearne & Gordon LLP

(57) ABSTRACT

A ventilation grille has an annular shape, and includes a panel and a lamp unit. The panel includes an intake opening provided around a central part of the annular shape, and a frame provided around the intake opening. The lamp unit is provided in the central part of the annular shape. The panel has a structure for attaching and detaching the lamp unit.

9 Claims, 8 Drawing Sheets

(56) References Cited

U.S. PATENT DOCUMENTS 10,345,001 B2* 7/2019 Zakula ..... F21V 15/02
2010/0009621 A1 1/2010 Hsieh
2012/0086340 A1* 4/2012 Hashizume ..... F21V 33/0096 315/112
2012/0087132 A1* 4/2012 Zakula ..... F21V 33/0096 362/294
2012/0087138 A1* 4/2012 Pringle ..... F24F 7/007 362/373
2013/0088855 A1* 4/2013 Ye ..... F21V 33/0096 362/96
2013/0223055 A1* 8/2013 Holland ..... F21V 7/005 362/218
2013/0266443 A1* 10/2013 Yang ..... F21V 33/0096 416/5
2014/0063796 A1* 3/2014 Zakula ..... F24F 13/078 362/231
2014/0078718 A1* 3/2014 Li ..... F21V 33/0088 362/96
2014/0112781 A1* 4/2014 Yang ..... F24F 7/065 416/5
2014/0252940 A1* 9/2014 Kinnune ..... F21V 29/508 313/46
2014/0360805 A1* 12/2014 Berkman ..... H04R 1/02 181/141
2015/0079895 A1* 3/2015 Casey ..... F24F 13/15 454/257
2015/0167990 A1* 6/2015 Zakula ..... F21V 33/0088 454/293
2015/0211763 A1* 7/2015 Zakula ..... F24F 13/078 454/293
2016/0069561 A1* 3/2016 Jonas ..... F21V 29/83 362/96
2016/0186974 A1* 6/2016 Zaderej ..... F21K 9/00 362/382
2016/0258581 A1* 9/2016 May ..... F21V 23/006
2016/0259351 A1* 9/2016 Barrett ..... F24F 11/62
2016/0312996 A1* 10/2016 Li ..... F21V 23/008
2016/0357199 A1* 12/2016 Matlock ..... G05B 15/02
2016/0370535 A1* 12/2016 Boomgaarden ..... F21V 23/02
2017/0009943 A1* 1/2017 Green ..... F21V 23/007
2017/0010018 A1* 1/2017 Yang ..... F04D 25/088
2017/0074503 A1* 3/2017 Horng ..... F24F 13/078
2017/0097147 A1* 4/2017 Myers ..... F21S 8/04
2017/0153005 A1* 6/2017 Cho ..... G02B 19/0014
2018/0245808 A1* 8/2018 Shima ..... F24F 7/025

* cited by examiner

PRIOR ART

VENTILATION GRILLE AND VENTILATION FAN

BACKGROUND OF THE INVENTION

1. Technical Field

The present disclosure relates to a ventilation grille and ventilation fan, installed in a ceiling or inner wall of building to ventilate by exhausting indoor air.

2. Description of the Related Art

A ventilation grille integrated with a lamp unit has been disclosed in the specification of U.S. Patent Application Publication No. 2013/0088855.

FIG. 8 is an exploded perspective view of a conventional ventilation grille. As shown in FIG. 8, conventional ventilation grille 100 is integrally configured with lamp unit 101. Lamp unit 101 is firmly screwed to panel 102. In other words, conventional ventilation grille 100 is configured based on the premise that lamp unit 101 is not detached from panel 102.

In the conventional ventilation grille integrated with the lamp unit as described above, it is not feasible or takes time to remove only an illumination part.

When the illumination part needs to be replaced, due to end of its service life or failure, parts other than the illumination part that do not need to be replaced also need to be replaced. This increases a burden on the environment and also on a user because of time needed for replacement.

To solve the above disadvantage of the prior art, an object of the present disclosure is to offer a ventilation grille and a ventilation fan in which the lamp unit is easily detachable from and also securely attachable to the panel without putting the burden on the user and environment.

SUMMARY OF THE INVENTION

To achieve the object, a ventilation grille of the present disclosure has an annular shape, and includes a panel and a lamp unit. The panel includes an intake opening provided around a central part of the annular shape, and a frame provided around the intake opening. The lamp unit is provided in the central part of the annular shape. The panel has a structure for attaching and detaching the lamp unit. Consequently, the intended object is achieved The present disclosure can thus offer the ventilation grille that allows easy detachment of the lamp unit from the panel and firm attachment of the lamp unit to the panel.

DETAILED DESCRIPTION

An exemplary embodiment of the present disclosure is described hereinafter with reference to the accompanying drawings. The exemplary embodiment described below is considered in all respects as illustrative and not restrictive of the technical scope of the present disclosure. Same reference marks are given to same components throughout the drawings to omit duplicate description.

Exemplary Embodiment

Figure 1:
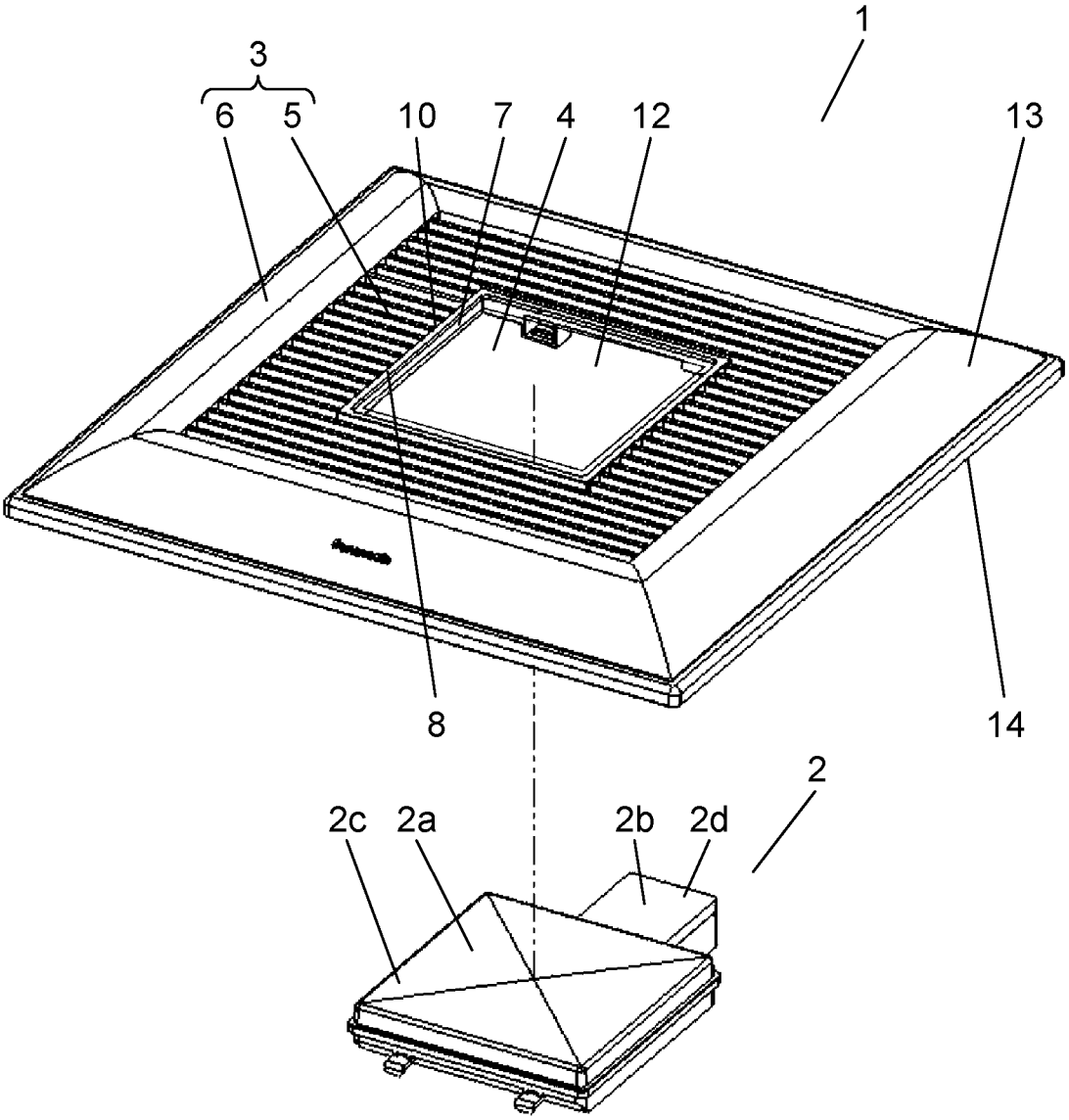
FIG. 1 is an exploded perspective view of a ventilation grille in accordance with the present disclosure.
Figure 2:
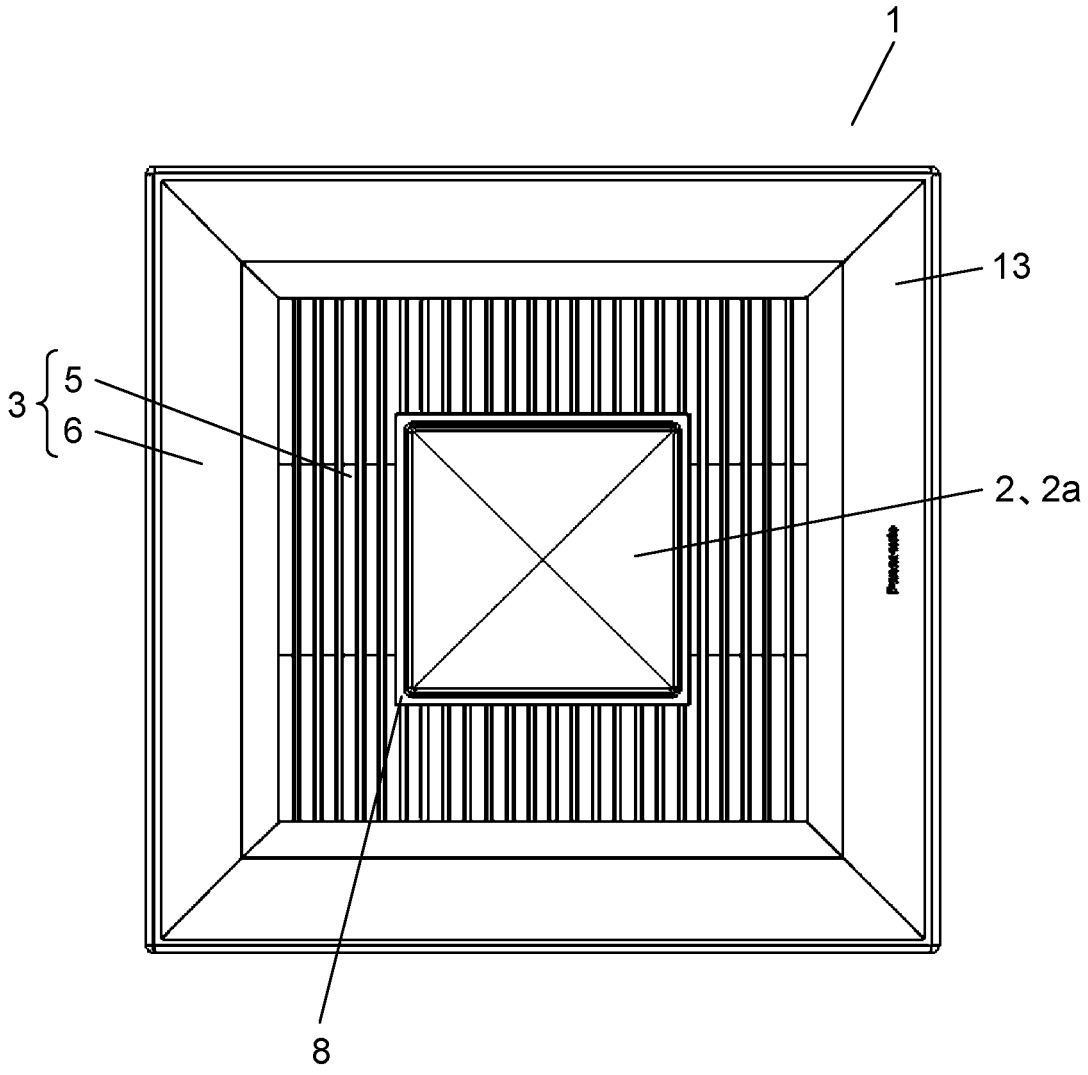
FIG. 2 is a front view of the ventilation grille in accordance with the present disclosure.
Figure 3:
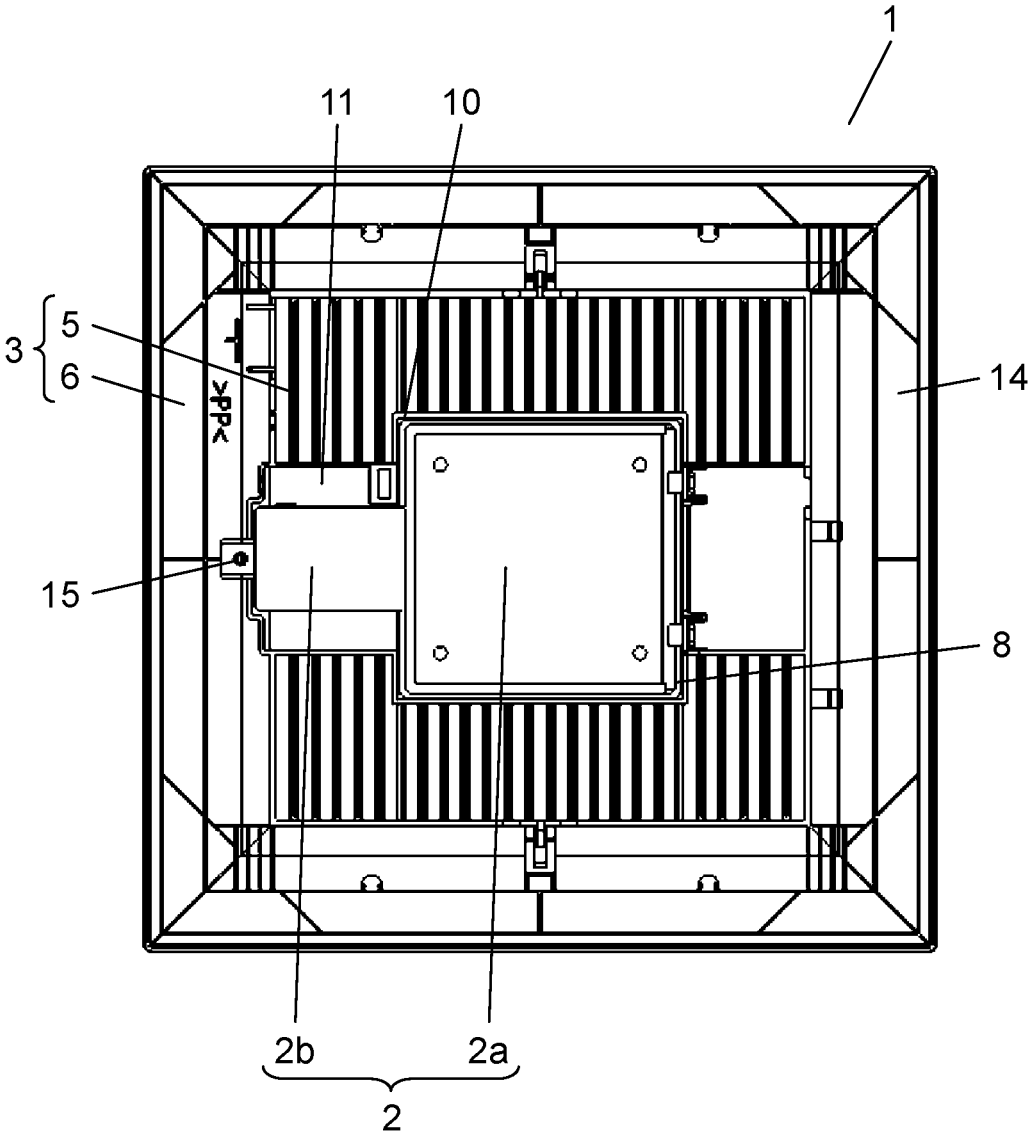
FIG. 3 is a rear view of the ventilation grille in accordance with the present disclosure.

A ventilation grille and a lamp unit in accordance with the exemplary embodiment of the present disclosure is described below with reference to FIG. 1, FIG. 2, and FIG. 3. FIG. 1 is an exploded perspective view of ventilation grille 1 in accordance with the present disclosure, and FIG. 2 is a front view of ventilation grille 1 in accordance with the present disclosure. FIG. 3 is a rear view of ventilation grille 1 in accordance with the present disclosure.

Ventilation grille 1 is disposed on a face exposed to a user in a ventilation fan body equipped with an air blower.

As shown in FIG. 1, ventilation grille 1 includes lamp unit 2 and panel 3.

Lamp unit 2 includes illumination part 2*a* and illumination controller 2*b*.

Illumination part 2*a* has a plate-like rectangular shape, and includes a light emitter, such as LED, inside. In illumination part 2*a*, the light emitter receives power and emits light so that plate-like flat part 2*c* functions as lighting. More specifically, a direction perpendicular to plate-like flat part 2*c* of illumination part 2*a* is the light-emitting direction.

Illumination controller 2*b* includes in its inside a control board for controlling luminance, brightness, ON/OFF, and so on of the light emitter inside illumination part 2*a*. Illumination controller 2*b* has a plate-like rectangular-parallelepiped shape, and plate-like flat part 2*d* is disposed parallel to plate-like flat part 2*c* of illumination part 2*a*. Illumination controller 2*b* is laterally disposed relative to the light-emitting direction of illumination part 2*a*.

Panel 3 has an annular shape. Opening 12 is provided in central part 4 of panel 3. The annular shape in the exemplary embodiment refers to a shape in which an opening is created near the center. The shape of opening 12 is rectangle and roughly corresponds to the shape of illumination part 2*a*. In other words, illumination part 2*a* can be disposed in central part 4.

Panel 3 includes intake opening 5 provided around central part 4 and frame 6 further provided around intake opening 5. More specifically, panel 3 has the annular shape, and includes intake opening 5 provided around central part 4 and frame 6 further provided around intake opening 5 in the annular shape. In the exemplary embodiment, a face of panel 3 exposed to user's eyes is front face 13, and a face to the side of the ventilation fan body where the air blower is installed is rear face 14.

Intake opening 5 is provided around an outer periphery of central part 4 to surround central part 4. Intake opening 5 is configured with multiple slits to let air pass through. Intake opening 5 is provided on one end face of ventilation grille 1 in the air flow direction.

Frame 6 is further provided around an outer periphery of intake opening 5 to surround intake opening 5. Frame 6 forms the outline of panel 3.

Panel 3 also has a structure that allows detachment of lamp unit 2. In the exemplary embodiment, the structure is regulating part 8 comprises a restricting part and is formed of a flat plate extending from inner peripheral face 7 of opening 12 provided in central part 4 of annular panel 3. In the exemplary embodiment, regulating part 8 is the flat plate annularly extending along inner peripheral face 7 of opening 12. However, regulating part 8 is not limited to this structure. For example, regulating part 8 may also be a protrusion provided on inner peripheral face 7 of opening 12.

Regulating part 8 restricts movement of lamp unit 2 in a direction from rear face 14 to front face 13 of panel 3. More specifically, lamp unit 2 is engaged with regulating part 8 by placing lamp unit 2 from rear face 14 in central part 4. Accordingly, regulating part 8 restricts movement of lamp unit 2 from rear face 14 toward front face 13. In other words, lamp unit 2 is supported substantially flush with panel 3. Lamp unit 2 is also screwed as required in the direction from rear face 14 to front face 13. In other words, lamp unit 2 is fixed to panel 3.

Panel 3 in accordance with the present disclosure includes regulating part 8 as the detachable structure. This restricts movement of lamp unit 2 in the direction from rear face 14 to front face 13 of panel 3. Accordingly, lamp unit 2 does not need to be firmly screwed to panel 3. Firm attachment of lamp unit 2 to panel 3 is described later. Lamp unit 2 can thus be easily detached from panel 3. More specifically, lamp unit 2 can be easily detached from panel 3 by removing panel 3 from the ventilation fan body. Since lamp unit 2 is easily removable from panel 3, lamp unit 2 can be removed from panel 3, for example, to wash entire panel 3 with water on cleaning ventilation grille 1.

As shown in FIG. 2, lamp unit 2 is disposed such that only illumination part 2*a* is visible on the side of front face 13 of ventilation grille 1 through opening 12 provided in central part 4 of annular ventilation grille 1. Central part 4 of annular ventilation grille 1 does not have to be the exact center. It is acceptable as long as movement of lamp unit 2 from rear face 14 to front face 13 is restricted by regulating part 8 provided on panel 3, and only illumination part 2*a* is visible on front face 13 of ventilation grille 1.

As shown in FIG. 3, illumination controller 2*b* is provided on rear face 14 of ventilation grille 1. More specifically, illumination controller 2*b* is provided on controller placement section 11. Here, controller placement section 11 is an area on intake opening 5 between rim 10 of opening 12 in central part 4 and frame 6.

In other words, regulating part 8 provided on ventilation grille 1 restricts movement of illumination part 2*a* from rear face 14 toward front face 13 of panel 3, and illumination controller 2*b* is provided on controller placement section 11. This makes only illumination part 2*a* exposed on front face 13 and restricts the position of lamp unit 2. In addition, illumination controller 2*b* is protected from waterdrop adhesion and human contact.

Still more, illumination controller 2*b* is disposed on controller placement section 11 provided on intake opening 5. Accordingly, illumination controller 2*b* is cooled by air taken in through intake opening 5, enabling to stabilize the control operation.

Furthermore, since illumination controller 2*b* is not disposed on the rear face of illumination part 2*a*, heat generated by illumination part 2*a* can be efficiently released toward the ventilation fan body. This contributes to a longer service life and stable operation of illumination part 2*a*.

Figure 4A:
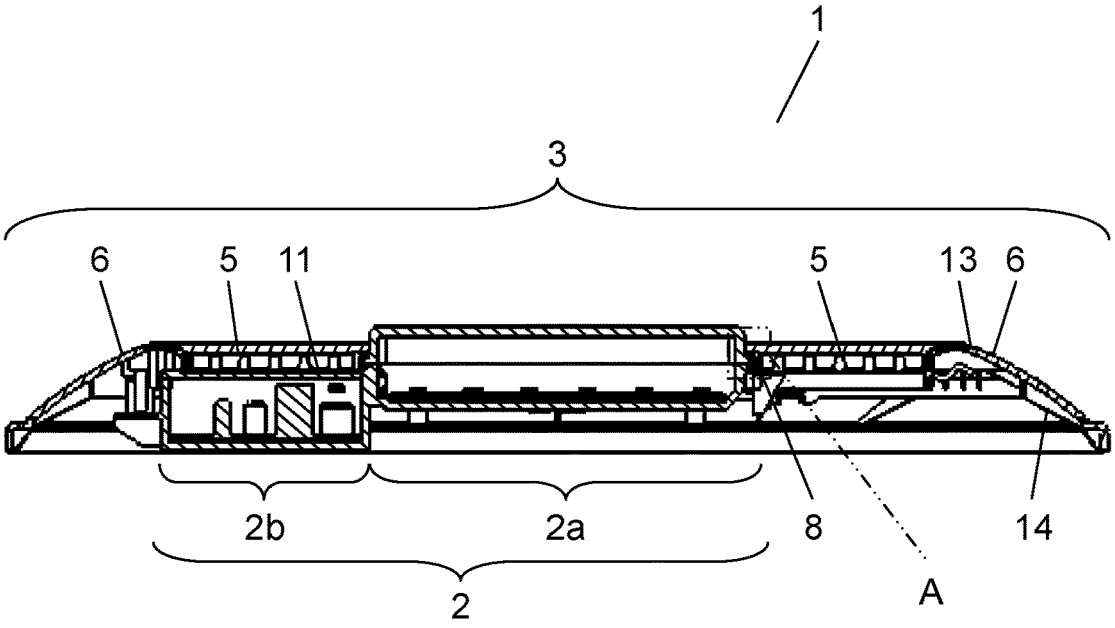
FIG. 4A is a sectional view of the ventilation grille in accordance with the present disclosure.
Figure 4B:
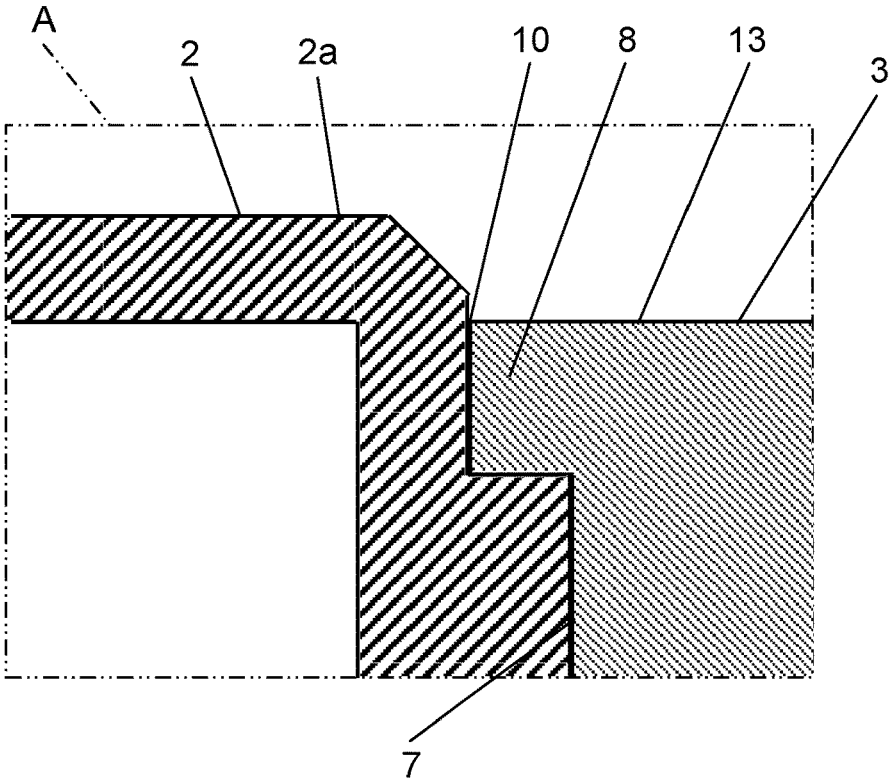
FIG. 4B is a fragmentary magnified sectional view of the ventilation grille in accordance with the present disclosure.

Next, connection of lamp unit 2 and panel 3 is detailed with reference to FIG. 4A and FIG. 4B. FIG. 4A is a sectional view of ventilation grille 1 in accordance with the present disclosure. FIG. 4B is a fragmentary magnified sectional view of ventilation grille 1 in accordance with the present disclosure. FIG. 4B is a magnified view of Part A surrounded by the two-dot chain line in FIG. 4A. As shown in FIG. 4A, illumination part 2*a* of lamp unit 2 protrudes from panel 3 in the direction of front face 13. Illumination controller 2*b* is disposed on controller placement section 11 provided on a portion of intake opening 5. Illumination controller 2*b* is placed such that it is not exposed from rear face 14 of panel 3 further in the direction of rear face 14.

Illumination part 2*a* does not always need to be protruded from panel 3, as long as illumination part 2*a* is placed at a position that light emission from illumination part 2*a* is visible. Lamp unit 2 is fixed to frame 6 on rear face 14 of panel 3. More specifically, lamp unit 2 is fixed to panel 3 by firmly attaching illumination controller 2*b* to frame 6.

As described above, the shape of opening 12 substantially corresponds to the shape of illumination part 2*a*. Regulating part 8, which is the detachable structure, restricts movement of illumination part 2*a*, i.e., lamp unit 2, from rear face 14 toward front face 13 of panel 3. This restricts movement of lamp unit 2 in the right and left direction, and also movement in the direction from rear face 14 to front face 13. Illumination controller 2*b*, i.e., lamp unit 2, is screwed to frame 6 in a direction from rear face 14 to front face 13, typically by a screw. This restricts movement of lamp unit 2 in the direction from front face 13 to rear face 14.

Accordingly, this structure facilitates detachment of lamp unit 2 from panel 3, and also firm attachment of lamp unit 2 to panel 3.

Illumination controller 2*b* is fixed to frame 6 typically via fixing part 15 in FIG. 3.

Figure 5:
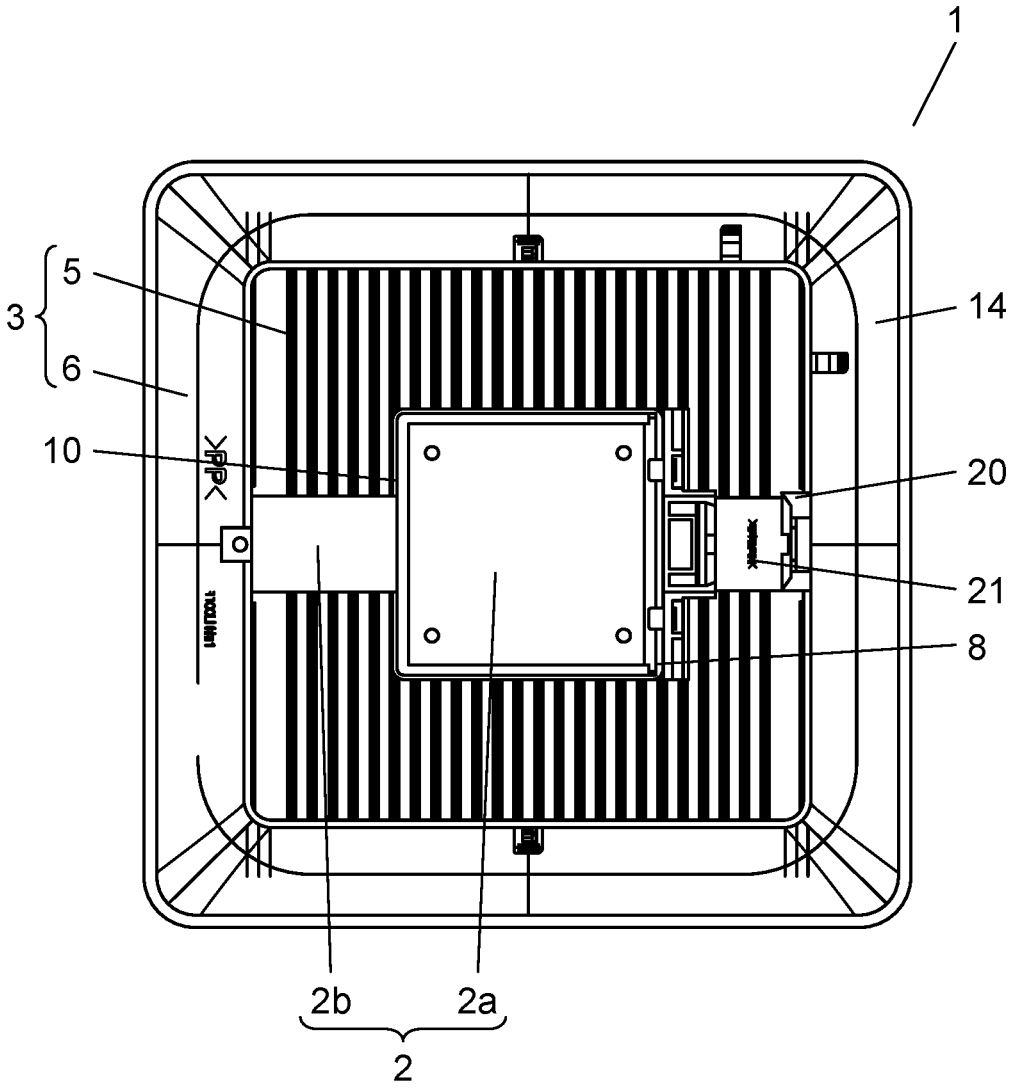
FIG. 5 illustrates a sensor installed in the ventilation grille in accordance with the present disclosure.

Next, the case of providing sensor 21 is described with reference to FIG. 5. FIG. 5 is a rear view illustrating the state that sensor 21 is installed in ventilation grille 1 in accordance with the present disclosure. Sensor 21 is, for example, a motion sensor that detects movement of human to operate a ventilation fan. Sensor 21 is provided on sensor placement section 20 on intake opening 5 in an area between rim 10 of opening 12 in central part 4 and frame 6 of panel 3. Sensor placement section 20 is provided at a position opposed to controller placement section 11 across central part 4.

Same as illumination controller 2*b*, a cooling effect is gained by providing sensor 21 in sensor placement section 20.

Still more, sensor 21 is provided at a position away from illumination part 2*a* and illumination controller 2*b* that generate heat. In addition, sensor 21 is not provided in a downstream of heat-generating parts in the air flow direction. Accordingly, degradation of detection capability due to effect of heat is preventable, and accurate temperature detection is further feasible when a temperature sensor is used.

Furthermore, by providing sensor 21 at a position opposed to illumination controller 2*b* across central part 4, appearance from front face 13 can be improved.

Sensor 21 does not always need to be a motion sensor. Any sensor for controlling the operation of the ventilation fan or lamp is applicable.

Figure 6:
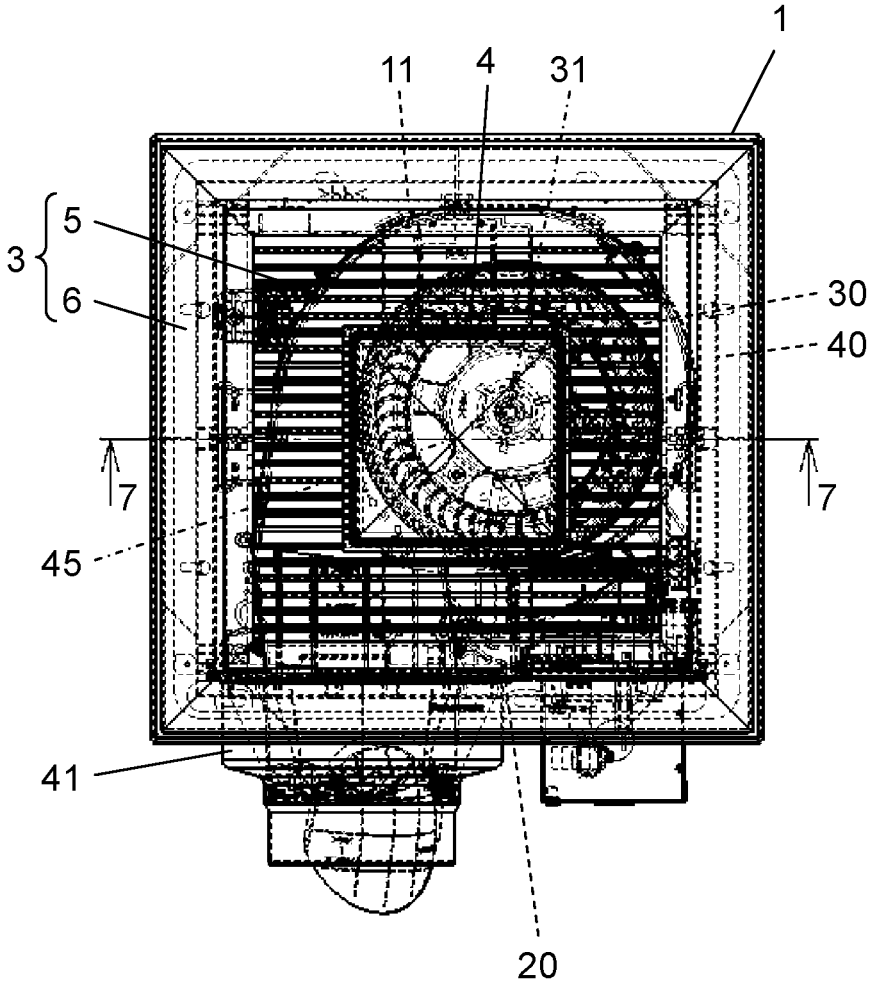
FIG. 6 is a front view illustrating a positional relationship of the ventilation grille in accordance with the present disclosure and an air blower.
Figure 7:
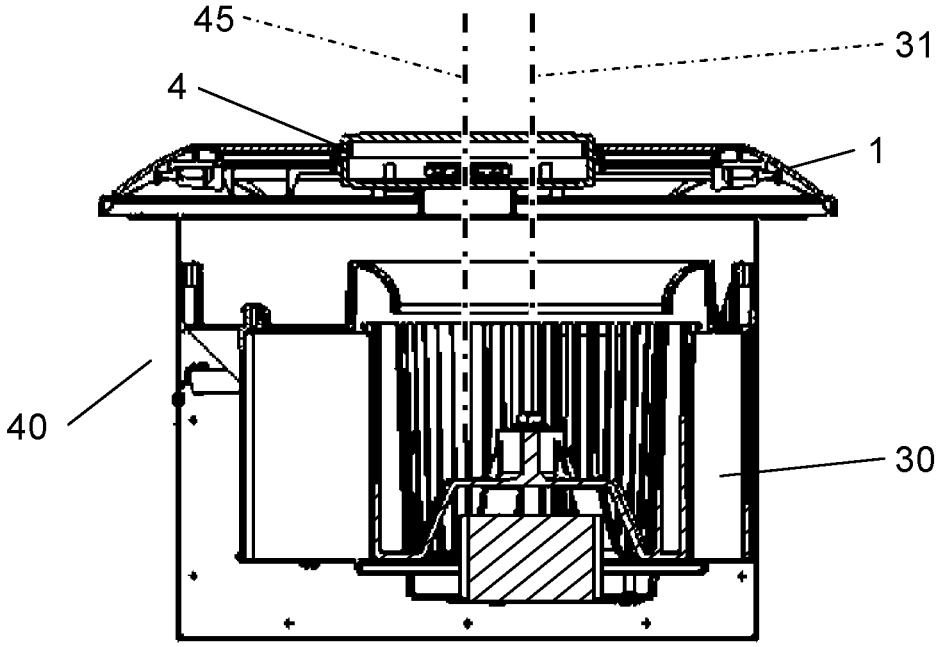
FIG. 7 is a side sectional view illustrating a positional relationship of the ventilation grille in accordance with the present disclosure and the air blower.
Figure 8:
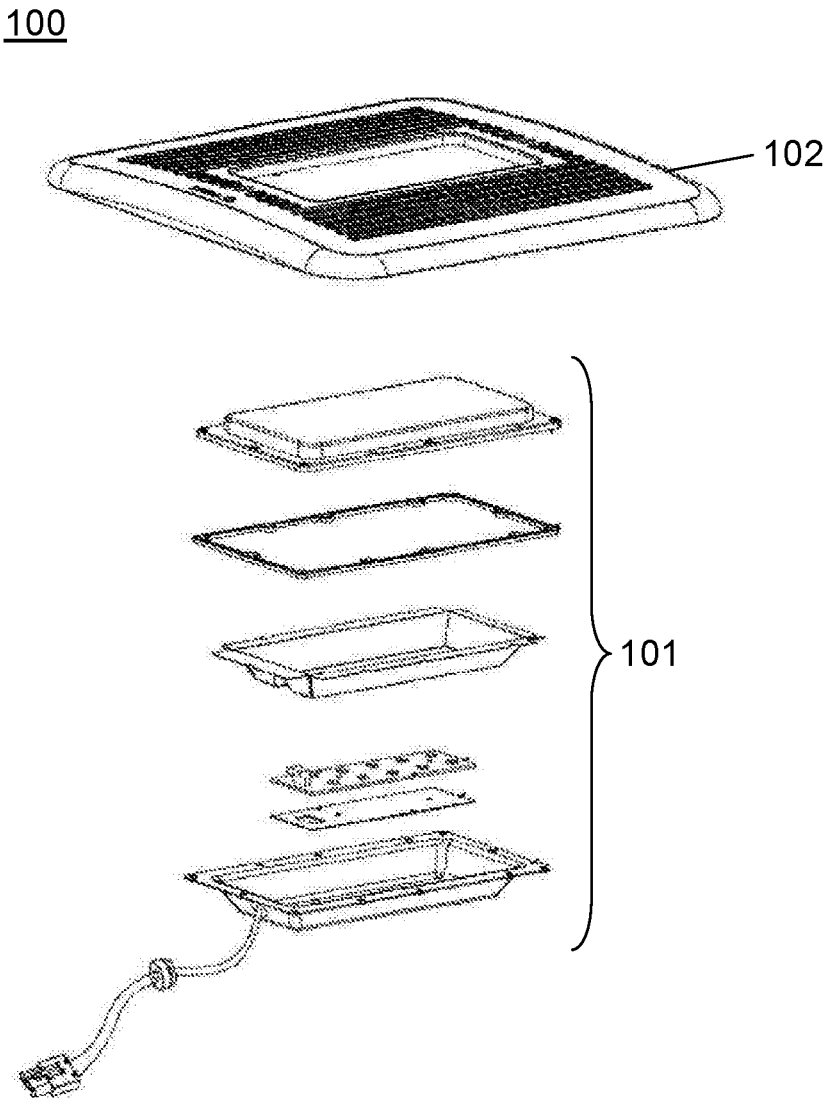
FIG. 8 is an exploded perspective view of a conventional ventilation grille.

Next is described a positional relationship of ventilation grille 1 and ventilation body 40 equipped with air blower 30 for taking in air, with reference to FIG. 6 and FIG. 7.

FIG. 6 is a front view illustrating a positional relationship of ventilation grille 1 of the present disclosure and air blower 30. FIG. 7 is a side sectional view illustrating the positional relationship of ventilation grille 1 in accordance with the present disclosure and air blower 30. FIG. 7 is a sectional view taken along line 7-7 in FIG. 6. As shown in FIG. 6 and FIG. 7, ventilation body 40 has a box shape with an opening on one face that functions as an intake port. Ventilation grille 1 is disposed on the intake port of ventilation body 40. Exhaust port 41 is provided on a side face of the box shape of ventilation body 40. Air blower 30 for guiding air from the intake port to exhaust port 41 is provided inside the box shape of ventilation body 40.

Air blower 30 is, for example, a centrifugal air blower including a scroll casing and sirocco fan. Rotation shaft 31 of a fan configuring air blower 30 is disposed perpendicular to a plane where the intake port is provided. Here, rotation shaft 31 is disposed in a state of being shifted from central part 4, as shown in FIG. 7. Strictly speaking, rotation shaft 31 is disposed while being shifted from center 45 of central part 4. A direction to shift rotation shaft 31 is preferably different from a direction of controller placement section 11 or a direction of sensor placement section 20. In other words, controller placement section 11 and sensor placement section 20 are preferably not provided on rotation shaft 31.

This makes air taken in by air blower 30 less likely to collide with controller placement section 11 and sensor placement section 20, and thus air blower 30 can easily take in air. Accordingly, performance of the ventilation fan can be improved.

The ventilation grille and the ventilation fan in accordance with the present disclosure are applicable to ventilation equipment installed typically in a ceiling of building.

What is claimed is:

1. A ventilation grille comprising:

a panel having an annular shape, and including an intake opening provided around a central part of the annular shape, a central opening provided in the central part of the annular shape, and a frame provided around the intake opening; and a lamp unit provided in the central part of the annular shape, wherein the panel includes a restricting part extending from an inner peripheral face of the central part, the restricting part is configured to restrict movement of the lamp unit in a direction from a rear face to a front face of the panel, the lamp unit is inserted into the central opening, and the restricting part projects inwardly from an entire interior perimeter of a portion of the inner peripheral face of the central part, wherein the lamp unit includes:

an illumination part configured to emit light; and an illumination controller laterally disposed relative to a light-emitting direction of the illumination part to control the illumination part, and wherein the ventilation grille further comprises a controller placement section on the intake opening in an area between a rim of the central opening and the frame, wherein the illumination controller is provided in the controller placement section.

2. The ventilation grille of claim 1, comprising:

a sensor placement section on the intake opening in an area between a rim of the central opening and the frame; and a sensor provided in the sensor placement section.

3. The ventilation grille of claim 2, wherein the sensor placement section is provided at a position opposed to the controller placement section across the central part of the annular shape.

4. The ventilation grille of claim 1, wherein the lamp unit is fixed to the panel at a rear face of the frame.

5. The ventilation grille of claim 1, wherein the lamp unit is supported substantially flush with the panel.

6. The ventilation grille of claim 1, wherein the lamp unit is screwed in the direction from the rear face to the front face of the panel.

7. A ventilation fan comprising:

the ventilation grille of claim 1; and an air blower configured to take in air, wherein a rotation shaft of the air blower is disposed in a state of being shifted from the central part of the annular shape.

8. The ventilation fan of claim 7, wherein the rotation shaft of the air blower is disposed in a state of being shifted in a direction different from a direction of the controller placement section.

9. The ventilation fan of claim 7, wherein the rotation shaft of the air blower is disposed in a state of being shifted in a direction different from a direction of the sensor placement section.

* * * * *